United States Patent [19]

Sitler

[11] 3,994,547

[45] Nov. 30, 1976

[54] SINGLE POINT SUSPENSION MEANS AND CABINET CONSTRUCTION THEREFOR FOR VERTICAL FILING OF SHEET MATERIAL

[75] Inventor: Richard W. Sitler, Costa Mesa, Calif.

[73] Assignee: Plan Hold Corporation, Irvine, Calif.

[22] Filed: Dec. 8, 1975

[21] Appl. No.: 638,339

[52] U.S. Cl. ..... 312/184

[51] Int. Cl.[2] ..... A47B 63/00; B42F 15/00

[58] Field of Search ..... 312/184, 185, 234.4, 312/234.5; 211/124, 123, 46, 48

[56] References Cited

UNITED STATES PATENTS

| | | | |
|---|---|---|---|
| 1,911,277 | 5/1933 | Helmer | 211/46 |
| 3,021,186 | 2/1962 | Immermann | 312/234.4 |
| 3,086,308 | 4/1963 | Ternouth | 312/234.4 |
| 3,165,104 | 1/1965 | Zippel | 312/184 |
| 3,172,711 | 3/1965 | Gillotte | 312/184 |
| 3,261,585 | 7/1966 | Constantini et al. | 248/243 |
| 3,302,800 | 2/1967 | Zdanowski | 211/123 |
| 3,570,678 | 3/1971 | Lundberg | 211/46 |
| 3,614,045 | 10/1971 | Cegielski, Jr. | 211/105.1 |
| 3,890,197 | 6/1975 | Butts et al. | 211/123 |
| 3,896,526 | 7/1975 | Joiner | 211/48 |

FOREIGN PATENTS OR APPLICATIONS

| | | | |
|---|---|---|---|
| 694,795 | 6/1965 | Italy | 312/234.4 |
| 6,705,624 | 8/1967 | Netherlands | 211/46 |

*Primary Examiner*—Paul R. Gilliam
*Assistant Examiner*—V. Sakran
*Attorney, Agent, or Firm*—Poms, Smith, Lande & Glenny

[57] ABSTRACT

A single point suspension device for filing sheet material in parallel vertical planes within or without a cabinet construction in which a horizontal support bar has a sidewardly opening longitudinal recess defined in part by a sidewardly extending hook and in which is received a suspension member attached to upper edge margins of sheet material to be filed. The suspension member includes a sidewardly directed recess defined in part by a hook, the hooks and recesses of the suspension member and the support bar being correspondingly configured for substantially complete interlocking interengagement along correspondingly configured surfaces and whereby the interengagement is accomplished with relative horizontal movement of the bar and suspension member, and wherein the interlocking engagement restricts angular relative movement of the support bar and suspension member. A cabinet construction having a chamber with side vertical frame members provided with sets of vertically spaced openings and detachable clip members for cooperable reception within said openings in said vertical frame members to vertically adjustable position a support bar having longitudinal grooves cooperable with spaced lateral walls on said clip members for holding said support bar at a selected height within said chamber. One or more support bars are provided in vertically spaced relation, the space interval being only slightly greater than the height of the sheet material to be filed and the height of the interlocked suspension member and support bar whereby unused space within the cabinet chamber between tiers of vertically filed sheet material is substantially minimized.

8 Claims, 11 Drawing Figures

Fig. 5.
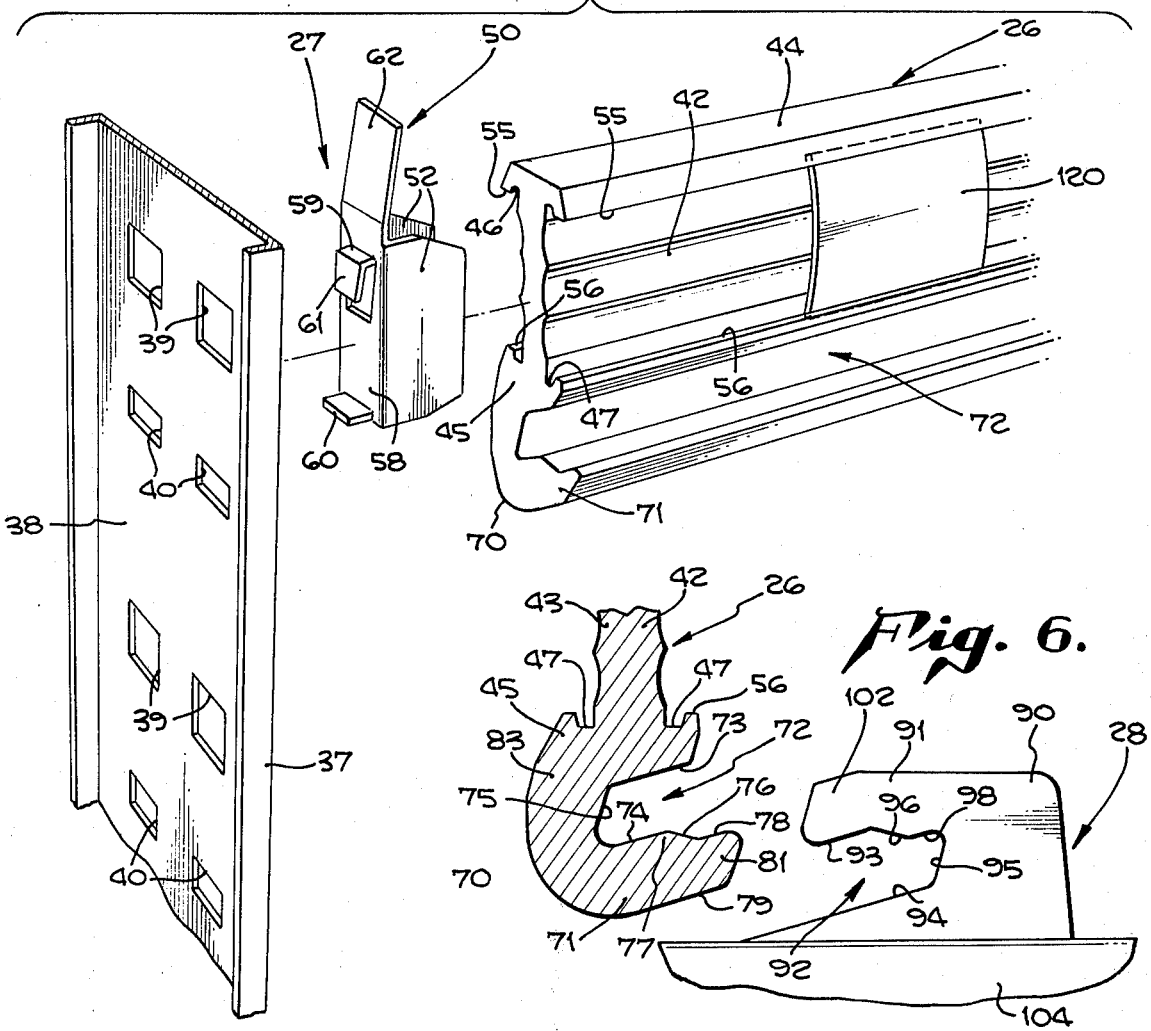
Fig. 6.
Fig. 8.
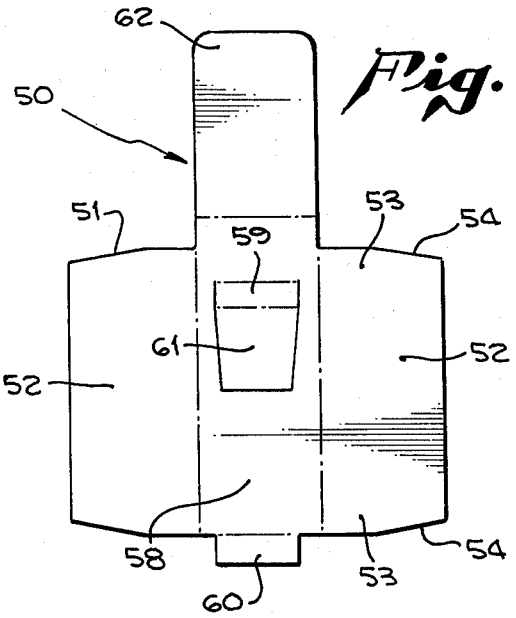
Fig. 7.
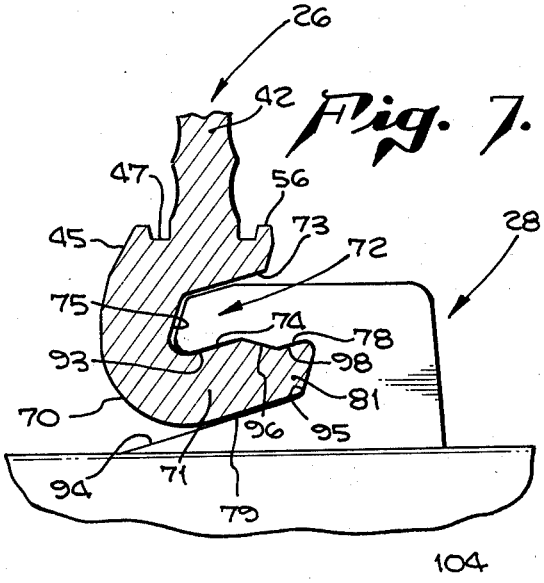

SINGLE POINT SUSPENSION MEANS AND CABINET CONSTRUCTION THEREFOR FOR VERTICAL FILING OF SHEET MATERIAL

BACKGROUND OF INVENTION

Sheet material such as engineering drawings, blueprints, building and construction specifications, maps of different size, charts, and various other types of printed matter of relatively large dimension and area are often vertically filed. When such sheet material was vertically suspended in chambers formed by a cabinet construction, access to the interior of the chamber was usually made from one direction through a front opening of the cabinet. Structure for supporting the sheet material was located within the chamber and often comprised transverse front to back spaced support bars. In prior proposed cabinet constructions the sheet material included a suspension member on the top margin of the sheet material which cooperated with the spaced support bars in the cabinet for holding the sheet material in vertical relation. In such prior constructions, the configuration of the suspension member required tilting of the sheet material in its vertical plane to cooperably engage the spaced support members. Such tilting of the sheet material required vertical space to accommodate movement of corner portions of the sheet material during such tilting. When cabinet constructions were provided with support bars for tiers or upper and lower banks of supported sheet material, the space required to accommodate such tilting of the sheet material when inserted or withdrawn from the cabinet increased substantially the height of the cabinet. In some prior examples, the height of the cabinet might be increased as much as 6 inches for each tier, thus a two tiered cabinet would require an overall cabinet height of an additional 12 inches and a three tier an additional cabinet height of 18 inches or more.

In addition, in such prior proposed cabinet constructions for vertical filing when a plurality of sheets were clamped in a friction binder which was supported from spaced support bars, laterally outwardly splaying of the lower edge portions of the sheet material would make such tilting movement of the sheet material more difficult and would require the use of one hand in order to quide the clamped sheet material into place. Often when a plurality of sheets of material were clamped in a binder means, the weight of the sheet material on the binder might range from 20 to 30 pounds and thus the clamped sheet material became difficult and awkward to handle. The support bar means in the cabinet was often required to support as much as 750 pounds of sheet material and thus required a strong, sturdy support means which would not sag or bend at the center portion of the support bar means.

Prior proposed support construction for suspending vertical files utilizing spaced support points engaged through a top opening in a suspension member are shown in U.S. Pat. Nos. 3,165,104, 3,275,004, 3,208,457, and U.S. Pat. 2,990,961. In each of these examples of prior suspension of vertical files, a substantial tilting and some reciprocal horizontal movement of the upper margin of the sheet material was required in order to engage the spaced support points.

In some prior constructions, a single bar was employed for suspending vertical sheet material, such bars being cylindrical in cross section or polygonal in cross section. Such bars were engaged by side opening suspension members carried on the top margin of a sheet of material and while they would be engaged by substantially horizontal relative movement, vertical movement was provided in order to engage the bar in a notch or recess to restrain horizontal movement. In such prior constructions, the sheet material was required to be first lifted upwardly and then moved horizontally in order to disengage the support means. Thus, again, substantial vertical space was required for insertion or withdrawal of vertically disposed sheet material and in some instances some tilting movement was permitted.

The support bar means of the prior proposed cabinet constructions often did not provide for adjustable positioning of one or more vertically spaced support bar means which also permitted convenient ready disassembly and assembly of the support bar means with the cabinet construction. In some instances clip means have been used in a cabinet frame member for holding a support bar means, such clip means cooperating with vertically spaced openings in a cabinet frame member.

SUMMARY OF INVENTION

The present invention contemplates a novel suspension means for supporting sheet material in spaced vertical planes within or without a cabinet construction in which many of the disadvantages of the prior proposed constructions are avoided and in which a novel single point suspension means provides horizontal insertion and withdrawal of vertical sheet material into and from the cabinet chamber in a convenient facile direct manner.

An object of the present invention is to provide a novel suspension means for filing vertical sheet material wherein insertion and withdrawal of the sheet material into and from suspended position are along respective unidirectional horizontal paths and without tilting movement of the sheet material.

Another object of the invention is to provide a novel suspension means for filing sheet material in vertical planes wherein cooperable engagement of a support bar means and a suspension means on the sheet material restrains the sheet material against tilting and also releasably locks the suspension member on the support bar means.

Another object of the present invention is to provide a cabinet construction in which vertical frame members are provided with means for vertically adjustably positioning a support bar means for a virtually single point suspension means for filing sheet material in vertical planes, and wherein the support bar means is releasably attached to the vertical frame members.

A further object of the present invention is to provide a cabinet construction in which means are provided for vertically adjustably releasably positioning a support bar means for a suspension means carried by top margins of sheet material to be filed in vertical planes in the cabinet construction.

A specific object of the invention is to provide a support bar member and a suspension member which are cooperable to be interengaged and interlocked by relative movement in a horizontal direction and wherein angular relative movement is restrained.

Another specific object of the invention is to provide a suspension means as stated above wherein the interlocking interengagement of the support bar means and the suspension means affords facile lateral relative movement along the support bar means while prohibiting angular movement in the vertical plane of the sheet material.

Another specific object of the invention is to provide a means for mounting a support bar means adaptable to cooperate with a suspension means from a cabinet frame member in a readily releasable manner.

Still another specific object of the invention is to provide a support bar means and suspension means which have corresponding interlocking configurations for cooperating in a novel manner and wherein various modifications of the suspension means are readily adaptable to sheet material arranged in one or more parallel planes.

Various objects and advantages of the present invention will be readily apparent from the following description of the drawings in which exemplary embodiments of the invention are shown.

IN THE DRAWINGS

FIG. 5 is an enlarged fragmentary exploded perspective view of a cabinet frame member, a support bar, and a hanger clip member for releasably attaching the support bar to the frame member.

FIG. 6 is a fragmentary enlarged view of the engagement portion of the support bar and a suspension member attachable to sheet material showing the approach of the suspension member to the support bar for interengagement therewith.

FIG. 7 is an enlarged fragmentary view similar to FIG. 6 showing the support bar and suspension member in interlocking engagement.

FIG. 8 is an enlarged plan view of a blank of sheet metal from which the hanger clip member shown in FIG. 5 is stamped and formed.

Figure 1:
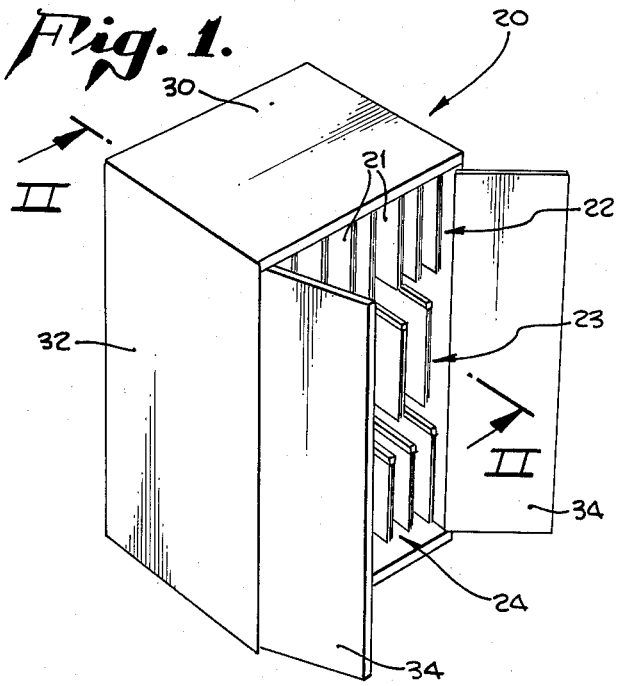
FIG. 1 is a perspective view of a cabinet construction embodying this invention, the doors of the cabinet being opened to show three tiers of vertically filed sheet material.
Figure 2:
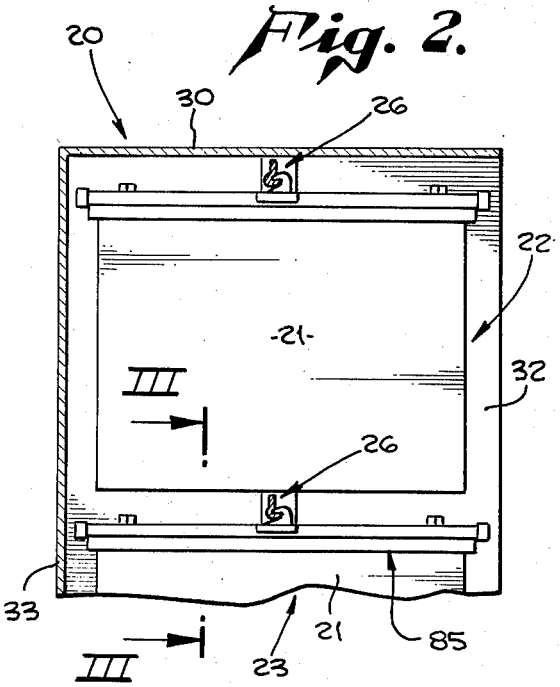
FIG. 2 is an enlarged fragmentary sectional view, the section being taken in a vertical front to back plane indicated by line II—II of FIG. 1.
Figure 3:
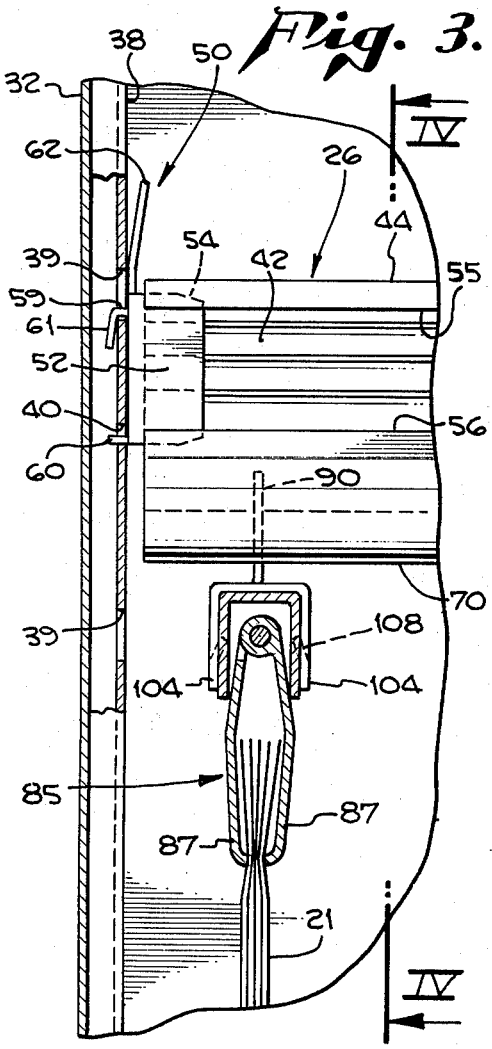
FIG. 3 is an enlarged fragmentary sectional view taken in the vertical transverse plane indicated by line III—III of FIG. 2.

In the drawings and particularly in FIGS. 1 and 2 a cabinet construction generally indicated at 20 embodying this invention is arranged for filing of sheet material such as 21 in a plurality of vertical planes and in a plurality of tiers generally indicated at 22, 23 and 24. The vertical sheet material in each tier 22, 23, 24 is carried by a support bar means 26 which extends horizontally and transversely across the cabinet. Each end of the support bar means 26 is vertically adjustably positioned by positioning means generally indicated at 27. (FIG. 3). The sheet material 21 is provided with a suspension means 28 which cooperably engages the support bar means 26 in a manner described in detail hereafter.

In this example of the invention, cabinet means 20 includes a top wall 30, a bottom wall 31, side walls 32, a back wall 33 and hinged door panels 34 at the front of the cabinet means to provide access to the cabinet chamber 35 defined by the cabinet walls from the front direction only. The height of the cabinet is designed to accommodate the three tiers of vertical filing material 22, 23, and 24. Dimensions of sheet material for which the cabinet means 20 may be designed may vary from 8½ by 11 inches to 42 by 60 inches in standard paper sizes for engineering and architectural drawings. In the larger size sheets, only one tier may be provided whereas in the smaller size sheets there may be two or more tiers provided in a cabinet construction.

Cabinet means 20 includes cabinet frame members 37 attached in suitable manner to side walls 32, the center line of frame members 37 corresponding to the center line of the side walls 32. Frame members 37 may be of any suitable cross sectional shape such as a channel section provided with a main web 38 having vertically spaced sets of openings 39 and 40 forming part of the positioning means 27 of the support bar means 26. Each set of openings 39 and 40 are symmetrical with respect of the center line of the cabinet frame member. When the frame members 37 are mounted on the cabinet side walls 32, the sets of openings 39 and 40 are located with the center line of the inner opening 39 and 40 of each set spaced rearwardly from the center line of the cabinet. As later described, this inwardly offset position of the inner openings 39 and 40 of each set permits the interengagement of the support bar means 26 and the suspension means 28 at approximately the center line of the cabinet means so that the single point suspension of the sheet material will be midway between the front and back of the cabinet chamber. The stamping of sets of openings 39 and 40 provides a cabinet frame member which can be utilized on either side wall 32 and avoids special left and right hand fabrication of the cabinet frame members.

Each support bar means 26 comprises a bar member 42 of lightweight extruded metal such as aluminum alloy and is cut to selected length to extend between the cabinet frame members 37 with a relatively loose end tolerance. Each bar 42 includes an upstanding web 43 of selected thickness to provide sufficient metal section in a vertical direction to resist bending or deflection when the support bar is carrying its maximum design load of vertically filed sheet material. Integral with upper and lower portions of the web 43 are laterally extending flange means 44 and 45 which define longitudinally extending groove means 46 and 47 which oppose each other and are provided on opposite sides of web 43, said flanges 44 and 45 with the groove means 46, 47 respectively serving to further reinforce side bar 42. At each end of bar 42 said groove means 46 and 47 cooperate with the position means 27.

Positioning means 27 includes in part, a metal clip member generally indicated at 50 which may be stamped from a blank of metal 51 as shown in FIG. 8. Clip member 50 includes a pair of spaced inboardly extending walls 52 of generally rectangular shape, the top and bottom edge portions 53 having edges tapered as at 54 for reception within the respective groove means 46 and 47. The walls 52 are relatively loosely received within said groove means, the minimum distance between the tapered edges at 54 being greater than the distance between the flange means 44 and 45 at the edges 55 and 56 thereof.

Clip member 50 also includes an elongated web 58 which forms the bottom wall of the U-shaped configuration of the clip member as defined by the laterally spaced walls 52, 52. Stamped and formed from web 58 are vertically spaced tabs 59 and 60 which extend from web 58 in a direction opposite to that of the laterally spaced walls 52. Tabs 59 and 60 are spaced apart a distance corresponding to the distance between the bottom edges of sets of openings 39 and 40 and are adapted to be received within said openings and then lowered into seating position on the bottom edges of openings 39 and 40. The upper tab 59 includes a downwardly extending portion 61 which prevents the clip member from being laterally withdrawn from the frame member without first lifting the clip member in relation to the openings 39, 40.

The main web 58 is provided with an end tab web portion 62 which is inclined toward the direction of said lateral spaced walls 52 and away from the surface of web 38 of the frame member 37. The inclined end tab portion 62 permits limited rocking of the clip member 50 within the openings 39, 40 to facilitate assembly and disassembly of support bar 42. The loose end tolerance of bar 42 and the tapered edges 54 also facilitate the rocking of clip 50.

Assembly and disassembly of support bar 42 with respect to the cabinet frame members 37 which are spaced apart a fixed distance includes first assembling clip member 50 with one end of bar 42 with the walls 52 fully inserted into the groove means 46, 47. The clip member 50 and the bar may then be moved toward the frame member 37 and the tabs 59 and 60 engaged with the openings 39, 40 respectively. Such interengagement is accomplished by tilting bar 42 with its oppostie end higher than the end being assembled with the frame member. Clip member 50 may then be assembled with the other end of bar 42 and said other end may be then lowered for insertion of the tabs 59 and 60 into the openings 39 and 40 of the opposite cabinet frame member 37. Because the tolerances are relatively loose, the bar 42 may have its axis inclined or misaligned with respect to the lateral walls 52 of each clip member because of the tapered edges 54 and the bar lowered so that the tabs 59 and 60 on the clip member at the opposite end of the bar 42 may be fully received and lowered into interlocking relation with the web 38 of the other cabinet frame member 37. Longitudinal tolerances between ends of bar 42 and the clip member are restricted so that the lateral walls 52 of each of the clip members are received within the groove means 46 and 47 a sufficient distance to support the bar.

In disassembly of the clip members 50, bar 42 and frame members 37, the tapered edges 54 and the loose tolerances between ends of the bar 42 and clip member and frame member permit disassembly by reversal of the assembly steps described above. Each clip member 50 is preferably made of steel and the vertical disposition of walls 52 provide metal distribution to support the bar 42.

Support bar means 26 also includes an engagement means 70 integral with the lower longitudinal portion of the web 43 and lower flange means 45. Engagement means 70 includes a laterally or sidewardly extending engagement hook portion 71 which forms with the adjacent edge of the flange means 45 a sidewardly opening or facing longitudinal recess means 72. Recess means 72 is defined by parallel inclined walls 73 and 74 which terminate at a recess back wall 75 formed on the opposite side of the center line of the web from that of the side opening of the recess means 72. Inclined wall 74 providing the bottom wall of recess means 72 or the top wall of hook portion 71 forms an obtuse angle as at 77 with a wall 76 providing one side of a shallow V shaped surface, the other side 78 of the V-shaped surface lying approximately parallel with the inclined bottom wall 74. The hook portion 71 is further defined by a lower wall 79 which lies generally parallel to the wall 74. It should be noted that the outer nose 81 of the hook portion 71 extends beyond the flange means 45 thereabove and that the angular inclination of the surfaces 74, 78 and 79 may be in the order of approximately 15° from a plane normal to the vertical center line of the bar. Hook portion 71 is of relatively thick section and the portion 83 of the hook portion which integrally joins the flange means 45 at the bottom of web 43 has a progressively increasing thickness to provide additional metal to strengthen the bar against bending.

Figure 4:
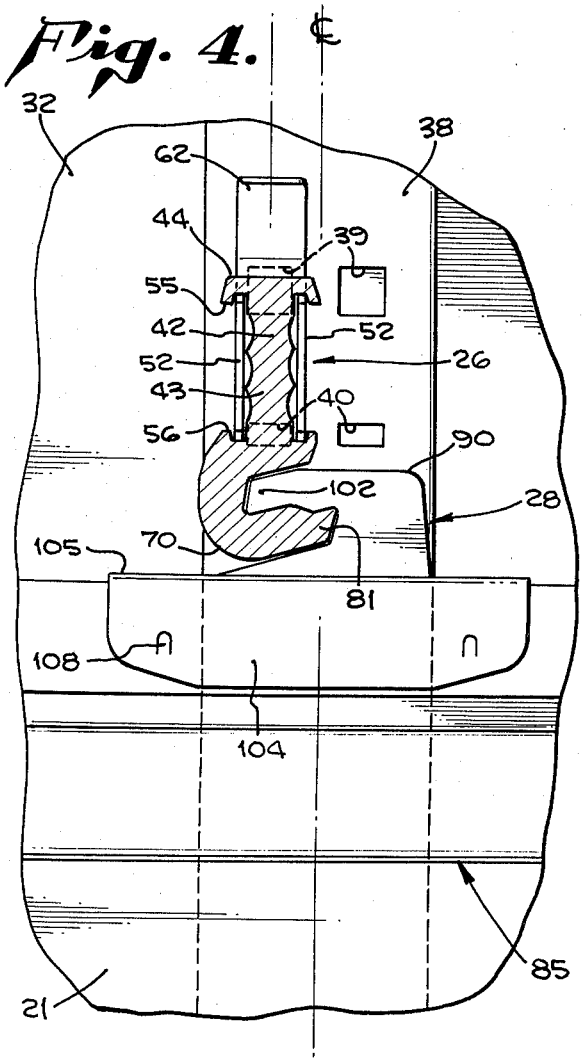
FIG. 4 is an enlarged fragmentary sectional view taken in the vertical plane indicated by line IV—IV of FIG. 3.
Figure 9:
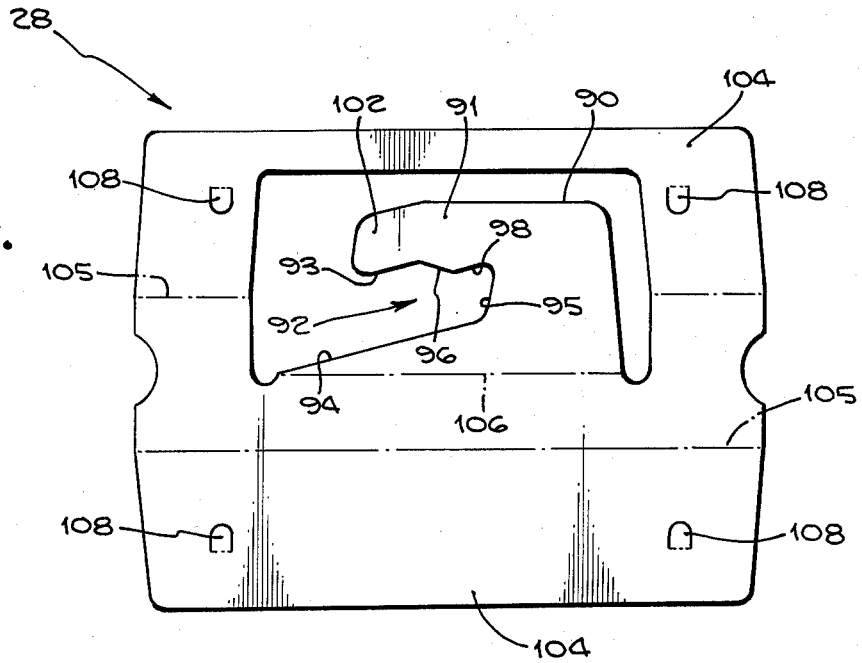
FIG. 9 is an enlarged view of a blank of metal sheet material from which the suspension member is stamped and formed.

Suspension means 26 in the example shown in FIGS. 1 – 7 inclusive and FIG. 9 is formed to be attached to a metal friction binder generally indicated at 85, FIGS. 2 – 4 which may be of a type shown and described in U.S. Pat. No. 2,990,961 which is owned by the assignee of this application. Such a friction binder 85 includes a rigid metal U-section channel member 86 within which a pair of jaws 87 may be moved inwardly and outwardly for clamping and release respectively of a plurality of sheets of material 21 clamped in said jaws. Suspension member 28 may be stamped and formed from a generally rectangular piece of flat metal stock (FIG. 9) in which engagement means 90 comprises an engagement hook portion 91 which defines a recess means generally indicated at 92 having parallel inclined edges 93 and 94 disposed at approximately 15° to the center line of the blank. Recess means 92 includes a recess back wall 95 and obtusely angled walls 96 and 98. The inclined bottom edge of the recess means 92 corresponds to and mates with the inclined lower wall surface 79 of the support bar. It will be readily apparent from a consideration of FIGS. 6 and 7 that the engagement portions 71 and 91 and the recess means 72 and 92 are correspondingly configured so that when engaged as shown in FIG. 7, engagement portion 91 of the suspension member is received within the recess means 72 with surfaces in corresponding mating relationship and the engagement portion 71 is received within the recess means 92 in similar matching corresponding interlocking relationship. The sidewardly directed openings of the recess means 72 and 92 and the configuration of the engagement portions permit the suspension means 28 to be moved horizontally as indicated in FIG. 6 into full interlocking engagement as shown in FIG. 7 with the support bar means. This is accomplished without tilting or vertical movement of the suspension means 28. When the engagement hook portions of the respective engagement means are fully inserted it will be noted that the mating corresponding configuration of bar and suspension member are fully interlocking to restrain unwanted disassembly of the suspension means with the support bar means.

It should also be noted that the interengagement of the hook portions 71 and 91 with the recess means 92 and 72 respectively retain the suspension member against relative angular movement in the plane of the sheet material with respect to the stationary fixed support bar. Thus, as viewed in FIG. 7 an attempt to tilt downwardly the right side of the suspension means 28 and the sheet material will cause contact and interengagement of the surfaces 73 and the top edge of the nose 102 of the suspension member. Also, the bottom surface 79 of the engagement portion 71 is contacted by the inclined edge 94 of the suspension member to restrict such tilting. Upward tilting of the right portion of the suspension member 28 and the sheet material carried thereby is restricted by the mating of the inclined surface portions of walls 73, 74 on the support bar and the nose 102 of the suspension member as well as the corresponding parts of the nose 81 on the bar and the internal portions of the recess means 92. Thus the suspension member and the sheets of material attached thereto are held in selected horizontal position in the plane of the sheet material.

The interengagement of the corresponding surface configuration of the support bar engagement means and the suspension member engagement means is provided with sufficient loose tolerance so that when the outer edge of the sheet material is lifted slightly as through about one degree, the suspension member 90 will readily slide along the support bar means without binding. Relocation of filed sheet material along the support bar means may be readily accomplished without withdrawal of the suspension member from the support bar means.

In forming the suspension means 28 it will be readily apparent that after the metal has been stamped out to form the engagement means 90 as shown in FIG. 9, the side walls 104 may be bent downwardly about bend lines 105 and the engagement means 90 may be bent upwardly about bend line 106 to provide the U-section suspension member as shown in FIG. 3. Walls 104 may have struck therefrom bent fastening darts 108 which may engage with the walls of the channel member 86 of the binder to fasten the suspension member at the center or balance point of the binder.

Figure 10:
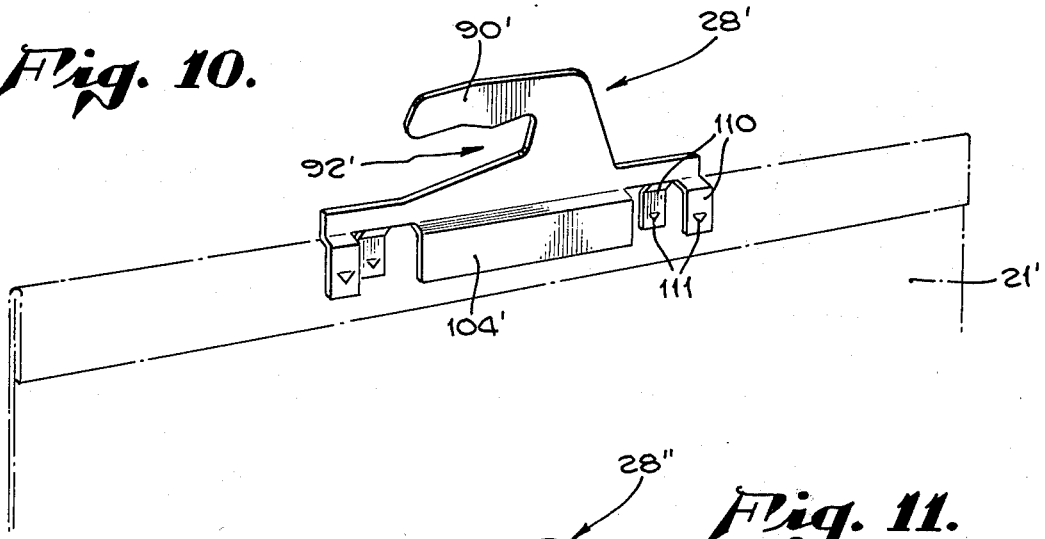
FIG. 10 is a modification of a suspension member adapted to be fastened to a single sheet of material.
Figure 11:
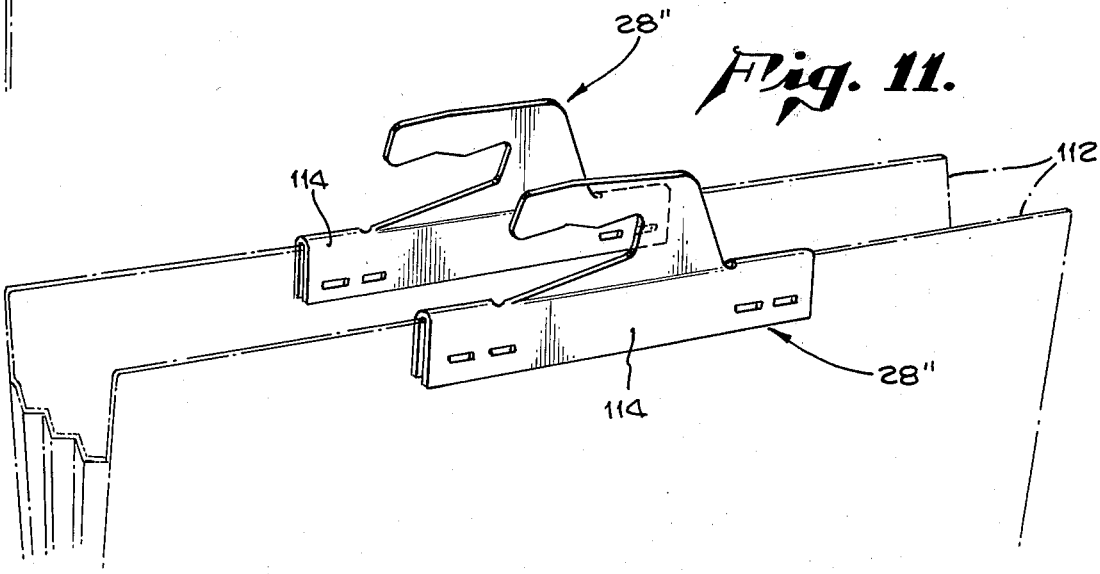
FIG. 11 is another modification of the suspension member showing a pair of such suspension members attached to top margins of a file envelope.

In FIGS. 10 and 11, modifications of the suspension member are shown. In FIG. 10 suspension means 28' has similarly constructed and configured engagement means 90' with recess means 92'. In this modification a single sheet of material 21' is to be utilized and the fastening portion of the suspension means 28' includes central walls 104' which embrace the top margin of the sheet material 21'. The suspension means 28' also includes end portions with depending legs 110 provided with fastening darts 111 for securement to the top margin of the sheet material 21'.

A somewhat different modification of the suspension means 28' as shown in FIG. 11 in which suspension means 28'' are carried by top margins of side walls 112 of an envelope type file folder. A suspension means 28'' is carried by each wall 112, each suspension means 28'' being configured as described above for interengagement with support bar means 26. Each suspension means 28'' may be secured to the top margins of the walls 112 by downwardly directed U-section members 114 which may be secured and fastened to the top margins of walls 112 in any suitable manner by the fastening darts or by suitable staples or the like.

The front opposed grooves 46, 47 on bar 26 serve as a convenient label holding means for identifying the locations of binders carrying sheet material to be vertically filed. Said labels may comprise one or more cards 120 of rectangular shape, bent slightly to convex form, and with longitudinal edges slidably received in the grooves. Suitable file identification indicia may be printed on the card face and corresponding indicia carried on the binder. A file is properly located when the identification indicia are matched. Various other types of identification indicia on suitable labels or cards may be used in cooperation with the grooves on the bar.

It will be apparent to those skilled in the art that the corresponding configuration of the engagement means on the support bar means and the suspension means is such that a sheet material equipped with the suspension means 28 may be moved horizontally through the opening of the cabinet and into interlocking engagement with the support bar means without tilting of the sheet material upwardly or downwardly. Since such tilting movement of the sheet material is not required, there is no interference with the leading end and bottom edges of the sheet material with sheet material of upper or lower tiers and therefore the space interval between tiers can be minimized and cabinet space more effectively utilized. The correspondence of the mating surfaces of the support bar means and suspension means, particularly including the angularly disposed surfaces 74, 76 and 96, 98 together with the weight of the sheet material filed, retains the suspension means against accidental release of the vertically filed material. In some instances a detent groove on the bar bottom face 79 and a detent button or protuberance on the suspension member edge 94 may be used for more positive locking if desired.

It will also be apparent that the positioning means for the support bar in the cabinet may be readily vertically adjustable and the interengagement of the clip member 50 with the cabinet frame members and the support bar is readily accomplished.

It will be understood that various modifications and changes may be made in the arrangement of the cabinet means, support bar means, positioning means for the support bar means and the suspension means which fall within the spirit of this invention and all such changes and modifications coming within the scope of the appended claims are embraced thereby.

I claim:

1. A suspension means for filing sheet material in vertical parallel planes comprising, in combination:

a horizontally extending support bar adapted to be arranged perpendicular to said vertical planes;

sidewardly opening recess means on said support bar and including an engagement hook portion;

said bar recess means having parallel top and bottom walls;

and a cooperable suspension member adapted to be connected with said sheet material and positionable normal to said support bar and in said vertical planes said suspension member including sidewardly opening recess means having parallel top and bottom walls and having an engagement hook portion cooperable with said bar hook portion upon horizontal relative movement therewith in one of said vertical planes, said hook portions and said recess means being substantially corresponding in cross-sectional configuration whereby said top and bottom walls on each of said recess means are cooperable with said hook portions to provide a sliding complementary fit for retaining said suspension member against relative angular movement in said vertical planes with respect to the support bar wherein said top and bottom walls of each of said recess means includes inclined walls at the inner portions of said recess means, and cooperable wall portions on the bottom wall of the support bar recess means and on the top wall of the suspension member recess means at intermediate portions thereof forming obtuse angles with said inclined walls.

2. In a suspension means as stated in claim 1 wherein said engagement hook portions on said support bar and on said suspension member include cooperable detent means for releasably and loosely retaining said suspension member on said bar.

3. In a suspension means as stated in claim 1 wherein said support bar includes an upstanding web integral with said hook portion, said web having a center line passing through inner portions of said recess means defined by parallel inclined surfaces.

4. In a suspension means as stated in claim 3 including longitudinally extending groove means on opposite sides of said web adapted to be cooperable with means for positioning said support bar at a selected vertical height.

5. A suspension means as stated in claim 1 wherein said suspension member includes attachment means for securement to an edge margin of said sheet material;

said attachment means including a pair of spaced walls embracing an upper marginal portion of said sheet material;

and means for fastening said walls to said sheet material.

6. In a cabinet construction for filing sheet material in vertical planes in one or more tiers in a cabinet chamber accessible from one direction, the combination of:

support bar means transverse to said one direction and positioned within said chamber for said sheet material;

said bar means including a vertically disposed web;

suspension means carried by said sheet material;

said bar means and said suspension means having cooperable hook and recess engagement means for interengagement of said suspension means upon horizontal linear relative movement in said one direction of said suspension means with respect to said bar means;

said hook and recess engagement means including downwardly inclined slidably engagable top and bottom complementary surfaces with respect to said direction of accessibility;

and means adjustably and releasably positioning said support bar means in said chamber with respect to said one direction for cooperable reception of said suspension means by horizontal non-tilting movement thereof in said one direction, wherein said positioning means includes a clip member at each end of said bar means and having spaced inboardly extending parallel walls; said support bar having longitudinally extending spaced parallel groove means at ends of said support bar and above said cooperable engagement means to receive edge portions of said walls.

7. In a cabinet construction as stated in claim 6 wherein said cabinet construction includes frame members having vertically spaced openings;

outboardly projecting tabs on said clip member for engagement with said frame members through said openings;

each clip member including an upstanding inboardly inclined tab permitting tilting of said clip member relative to said frame members to facilitate assembly and disassembly of said support bar means with said frame members.

8. In a cabinet construction as stated in claim 6 wherein said cabinet construction includes frame member having vertically spaced openings, and said clip member has spaced outboardly projecting tabs receivable within said openings;

the spacing of said openings and the horizontal movement of said suspension means providing arrangement of said support bar means whereby vertical space between tiers is approximately slightly greater than the height of said support bar means.

* * * * *